US005085901A

United States Patent [19]

Johnson et al.

[11] Patent Number: 5,085,901

[45] Date of Patent: Feb. 4, 1992

[54] ARTIFICIAL CHRISTMAS TREE

[76] Inventors: Arlie Johnson; Barbara E. Johnson, both of 1016 Spudrun Rd., Chillicothe, Ohio 45601

[21] Appl. No.: 647,950

[22] Filed: Jan. 30, 1991

[51] Int. Cl.[5] ..... A47G 33/06

[52] U.S. Cl. ..... 428/19; 211/196; 211/205; 428/20; 493/956

[58] Field of Search ..... 428/18, 19, 20; 493/956; 211/196, 205

[56] References Cited

U.S. PATENT DOCUMENTS

| | | | |
|---|---|---|---|
| 3,031,785 | 5/1962 | Carlson | 428/8 |
| 3,647,605 | 3/1972 | Spiegel | 428/18 X |
| 3,674,612 | 7/1972 | Gehl, Jr. | 428/7 |
| 3,692,617 | 9/1972 | Marks et al. | 428/20 |
| 3,967,019 | 6/1976 | Magee | 428/18 X |
| 4,748,058 | 5/1988 | Craig, Jr. | 428/9 |
| 4,756,936 | 7/1988 | Frank et al. | 428/19 X |
| 4,968,541 | 11/1990 | McCrory | 428/20 X |

FOREIGN PATENT DOCUMENTS

| | | | |
|---|---|---|---|
| 3121037 | 12/1982 | Fed. Rep. of Germany | 428/18 |

*Primary Examiner*—Henry F. Epstein
*Attorney, Agent, or Firm*—Biebel & French

[57] ABSTRACT

An artificial tree has a top section, a bottom section and a centrally positioned vertical pole which is height adjustable. The top section has a top member and a plurality of rings with the lower most ring also having a plurality of spokes interconnecting the ring with an inner hub. A plurality of strings depend downwardly from the top member and secure each of the other rings in their desired parallel positions. The bottom section also has a plurality of rings with the upper most and lower most rings having spokes and inner hubs. The rings of the bottom section are also connected together by string. The upper most ring of the bottom section sets atop the height adjustment means. In addition to the pole preferably having two sections telescopically oriented with respect to each other, the tree also is formed with strands of garland and preferably ornaments secured thereto. In an alternative embodiment the tree includes an open space essentially at the vertical midpoint of the tree for use associated with a holiday display.

17 Claims, 6 Drawing Sheets

ARTIFICIAL CHRISTMAS TREE

BACKGROUND OF THE INVENTION

The present invention relates generally to artificial trees and the like, and more particularly, to artificial Christmas trees.

Artificial trees have received substantial acceptance over the years due to their convenience, affordability, and relatively easy maintenance. Many artificial trees have utilized a pole construction, into which radially extending branches of twisted wire are inserted. The pole is utilized as an attempt to simulate a natural tree trunk. However, this construction technique presents substantial problems in terms of manufacturing costs, transportation, storage, and assembly problems. For example, the pole has to be formed, cut to size and special pole drilling equipment used. The pole must be pre-drilled to provide an accurate number of holes to receive the branches. This operation requires several manual steps by an operator as well as the expenditure of substantial sums for special drilling equipment. Further, different size branches must be made to simulate the gradual taper of the natural tree, with these branches required to be inserted into the pole in a preselected pole position.

As a consequence, a number of artificial Christmas tree designs have been proposed. Examples of such trees are shown in German Offenlegungsschrift Publication Number 3121037 entitled Decoration for Use on Recurrent Holidays by Hedwig Frank, and U.S. Pat. Nos. 3,031,785 for a Knock-down Artificial Tree invented by C. W. Carlson; 3,692,617 for a Modular Tree Using Tapered Frame and Rings of Branches invented by T. Marks, et al; and 4,748,058 for an Artificial Tree invented by Chester Craig, Jr.

Unfortunately, each of those patents feature drawbacks such as ease of assembly, aesthetic appearance, or flexibility for use also as a Christmas display. For example, elderly individuals or individuals suffering from arthritis may encounter difficulty in assembling some of the prior art trees.

It is thus apparent that the need exists for an improved artificial tree or the like which can be used as a Christmas tree as well as a Christmas display.

SUMMARY OF THE INVENTION

The problems associated with the prior artificial Christmas trees are overcome in accordance with the present invention by forming an artificial tree having a top section, a bottom section, and a centrally positioned vertical pole having means for height adjustment. The top section comprises a top member, a top section base ring, and a plurality of rings interposed between the top member and the top section bottom base ring. A plurality of strings depend downwardly from the top member and are secured to each of the rings including the top section base ring.

The bottom section comprises a bottom section top ring and a bottom section base ring with a plurality of rings interposed between those rings and with a plurality of strings depending downwardly from the bottom section top ring to the bottom section base ring. Each of the intermediate rings is secured to the string. The top section base ring, the bottom section top ring and the bottom section base ring each comprise an inner hub with a plurality of spokes connecting each of the respective hubs with the respective top ring or base rings.

The centrally positioned vertical pole includes height adjustment means that are of a greater diameter than the outer diameter of the pole. The height adjustment means has a top surface as does the pole itself. The bottom section top ring is positioned adjacent the height adjustment means while the top member is positioned adjacent the top surface of the pole.

The top member comprises a conic position and a cylindrical portion, with the cylindrical portion having formed therein a plurality of apertures and having a hollow tubular insert positioned therein. Further, the pole comprises telescopically oriented upper and lower pole sections.

Preferably the tree is formed having strands of garlands secured to a respective ring, top section base ring, bottom section top ring or a bottom section base ring. Additionally, ornaments are secured to the strands of garland. In a modified form of the invention, a planar structure is superposed above the bottom section top ring. In both embodiments, the top section is collapsible upon itself as is the bottom section.

It is a primary object of the present invention to provide an artificial Christmas tree which is easy to assemble and inexpensively formed.

It is yet another object of the present invention to provide an artificial Christmas tree which may be decorated and stored with the ornaments secured to the tree for easier assembly the following year.

It is still another object of the present invention to provide an artificial Christmas tree which requires relatively little space to store.

Other objects and advantages of the invention will be apparent from the following description, the accompanying drawings, and the appended claims.

DETAILED DESCRIPTION OF THE INVENTION

Figure 1:
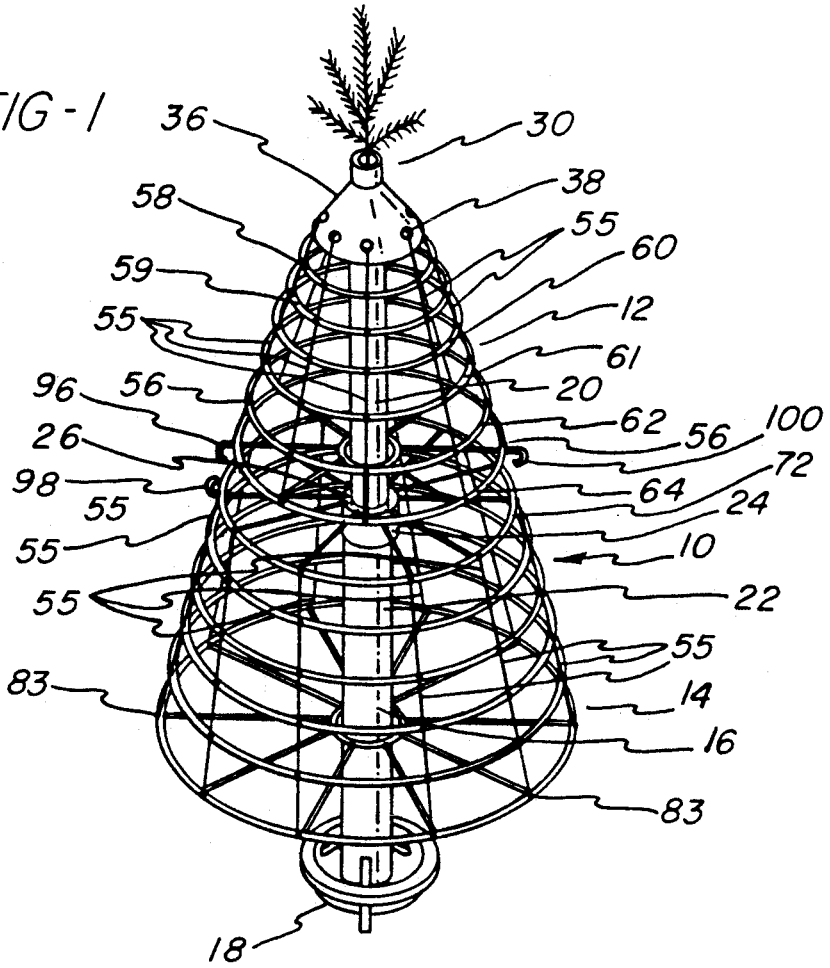
FIG. 1 is a perspective view of an artificial Christmas tree made in accordance with the present invention.

Having reference to the drawings, FIG. 1 discloses the framework for the artificial Christmas tree of this invention designated generally by the numeral 10. This particular artificial tree has as its major components a top section 12, a bottom section 14, and a pole 16 adapted to fit in a conventional artificial Christmas tree stand shown in representative form as stand 18. The pole 16 preferably is of aluminum and is of the type known as a telescopically adjusted pole having an upper pole section 20, a lower pole section 22 approximately 3" in height and height adjustment means 24 which typically is in the form of a clamp. As shown in FIG. 1, this height adjustment means 24 has an adjustment means top surface 26. As can also be seen, this height adjustment means is of a greater diameter than the outer diameter of either section of the pole.

Figure 2:
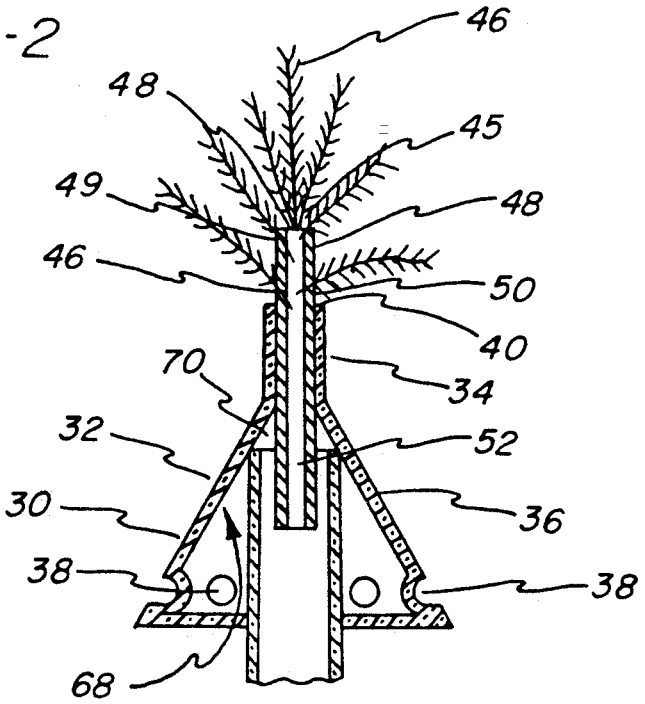
FIG. 2 is a vertical cross sectional view taken across the center of the top member.

As can be seen in FIGS. 1 and 2, the artificial Christmas tree of this invention also comprises a top member 30 having a conic structure 32 and cylindrical portion 34. The conic structure 32 has conic sidewall 36 with a plurality of sidewall apertures 38 formed therein at equally spaced intervals. The cylindrical portion features a top aperture 40 through which passes a tubular insert 45. This insert is preferably ⅜ inch copper tubing which is 12" long.

Artificial branches 46 associated with the top member 30 extend through tube apertures 48 which include the tube top 49 and a plurality of such apertures formed in tube sidewall 50. The bases for each of the branches 46 project through the tubular insert 45 along a tube cavity 52. This tube cavity 52 extends from the top of the tubular insert 45 downwardly, preferably to the bottom of the tubular insert.

Figure 4:
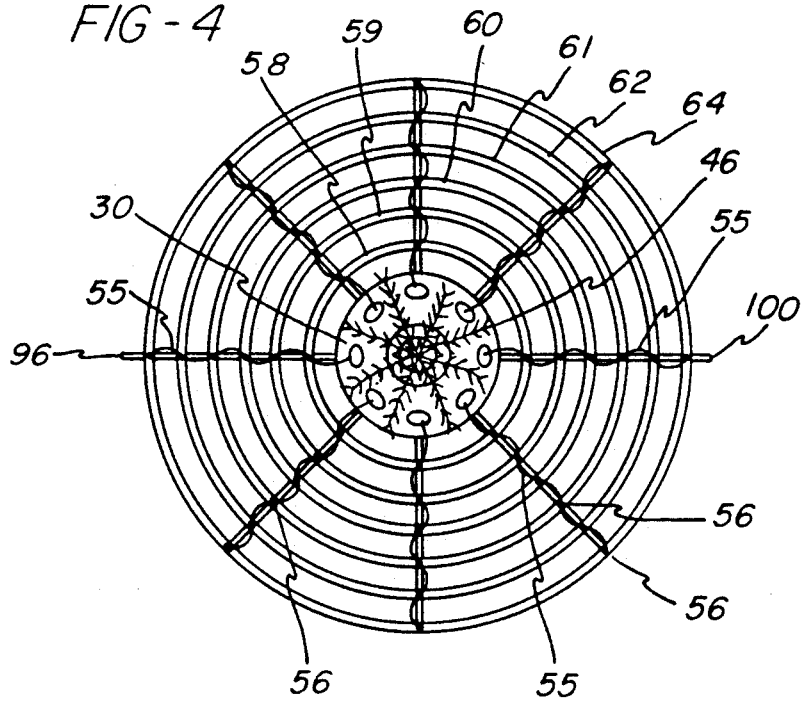
FIG. 4 is a top plan view of the top section of this invention prior to assembly.

As can best be seen in FIG. 1, but as is also shown in FIG. 4, a plurality of strings 55 have their one end secured through the top member 30 at the location of the sidewall apertures 38. The string which is preferably nylon, then extends downwardly to a series of equidistantly spaced top section attachment points preferably corresponding in number to the number of sidewall apertures 38. These equidistantly spaced top section attachments points 56 occur on a plurality of rings 58, 59, 60, 61 and 62 of increasingly larger diameter which are associated with the top section 12 with the smallest diameter ring 58 being located adjacent top member 30.

Figure 3:
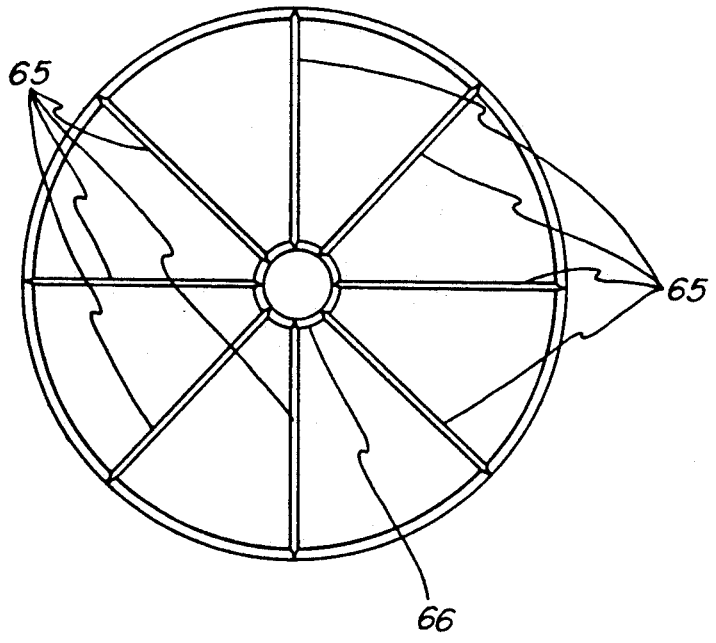
FIG. 3 is a top plan view of the top section base ring.

The top section 12 also comprises a top section base ring 64 as can be seen in FIGS. 1, 3 and 4, but is best seen in FIG. 3. This top section base ring 64 has a plurality of top section base ring spokes 65 emanating outwardly from the top section base ring inner hub 66 and connected to the outer section of the top section base ring. The top section base ring inner hub 66 is of a diameter which is greater than the outer diameter of the upper pole section 20. However, it is also desirable that the diameter of the inner hub 66 not be greater than the outer diameter of the height adjustment means 24.

As can be seen in FIG. 2, the upper pole section 20 has the top section 12 attached thereto by the frictional engagement of the upper pole section 20 with the conic inner surface 68 of top member 30. The upper pole section top 70 is in direct frictional engagement with the conic inner surface 68. Preferably the weight is equally distributed across the conic inner surface. To assist in the placement of the upper pole section 70 within the conic structure 32, the tubular insert 45 preferably extends downwardly into the upper pole section past the upper pole section top 70.

Figure 5:
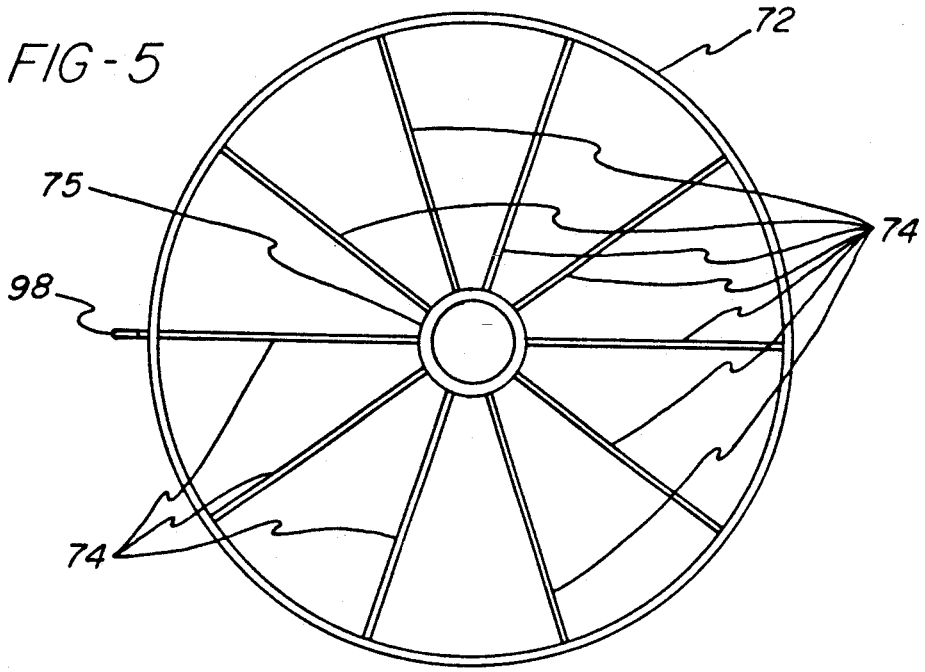
FIG. 5 is a top plan view of the bottom section top ring.
Figure 6:
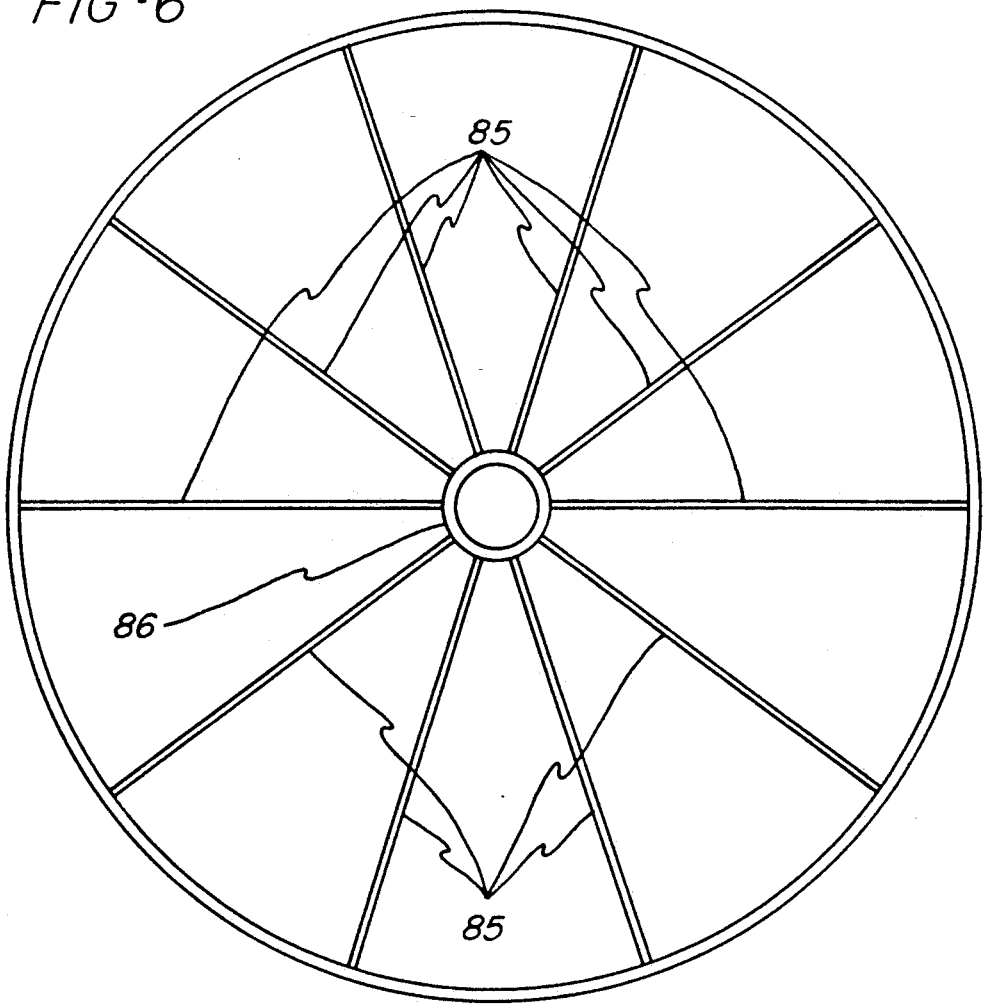
FIG. 6 is a top plan view of the bottom section base ring.
Figure 7:
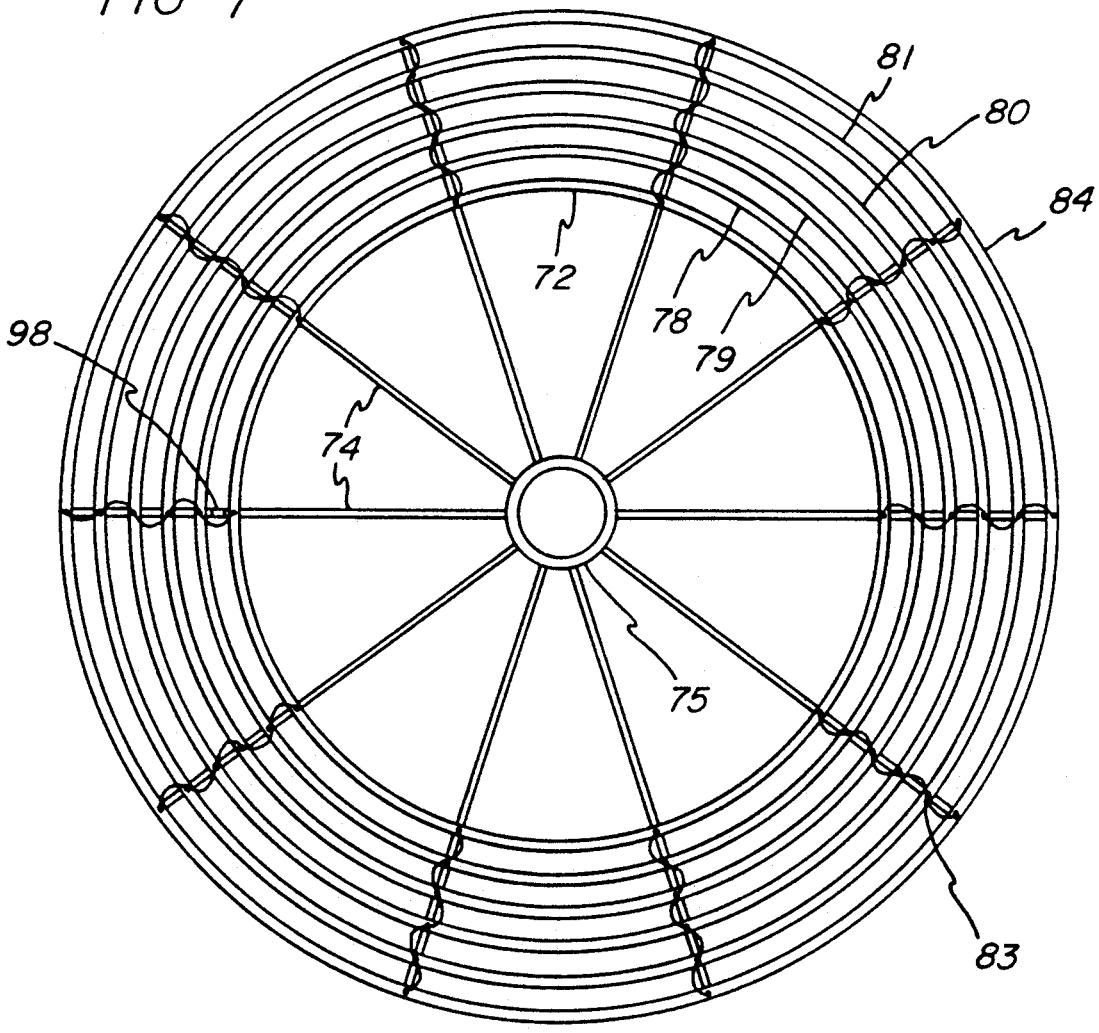
FIG. 7 is a top plan view of the bottom section of the artificial tree of this invention prior to assembly.
Figure 8:
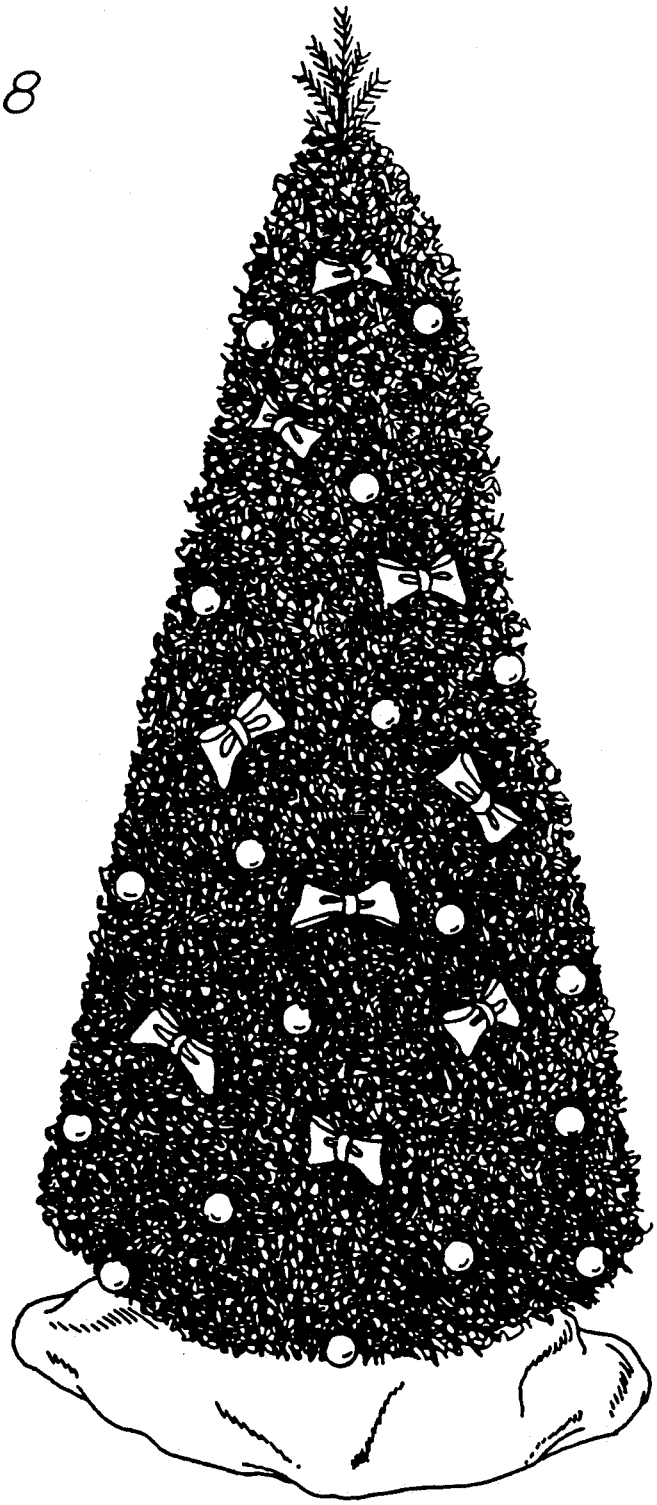
FIG. 8 is a perspective view of the artificial tree embodying this invention when fully assembled and decorated.

As can be seen in FIGS. 5, 6, and 7, the bottom section 14 is comprised of a bottom section top ring 72 which is best shown in FIG. 5. This bottom section top ring has a plurality of bottom section top ring spokes 74 which preferably are equal to, or somewhat greater in number than, the number of the top section base ring spokes 65. The bottom section top ring spokes 74 emanate outwardly from a bottom section top ring inner hub 75 which is of a diameter greater than the outer diameter of the upper pole section 20 but of a lesser diameter than the height adjustment means 24 such that it may rest on the adjustment means top surface 26.

The bottom section 14, similar to the top section 12, also is comprised of a plurality of rings 78, 79, 80 and 81 with these rings also being of increasingly greater diameters and with ring 78 located adjacent the bottom section top ring 72. The bottom section 14 also includes a bottom section base ring 84 such that in totality the rings 58–62, 64, 72, 78–81 and 84 increase in diameter as they depend downwardly from top member 30. As is the case with the top section 12, the bottom section 14 has its rings depend downwardly from the bottom section top ring 72 and secured at equidistantly spaced attachment points 83. All the rings of the top and bottom sections preferably are formed of No. 10 wire with the ends of the wire either welded together or secured in ¼" copper tubing.

The bottom section base ring 84 has a plurality of bottom section base ring spokes 85 which preferably correspond to the number of bottom section top ring spokes 74. The bottom section base ring spokes 85 emanate outwardly from a bottom section base ring inner hub 86 which is of a diameter greater than the outer diameter of the lower pole section 22. Preferably too, the bottom section base ring inner hub 86 is also of a diameter greater than that associated with the height adjustment means 24. All the spokes of this invention are preferably secured to their respective rings and hubs by braising. Further, although the spokes are shown as terminating at the outer rings, they could extend further outwardly.

A pair of red loops or hooks 96 and 98 extend outwardly from the top section base ring 64 and the bottom section top ring 72 respectively. These brightly colored loops provide a location for the placement of any plugs for tree lights, thus making it easy to locate the plugs when needed. Additionally, a green loop 100 extends outwardly from the top section base ring 100 to provide for easy identification of the separation point between the top and bottom sections of the tree, especially when the tree is arranged in the alternative embodiment set forth below.

As can be seen in FIG. 7, strands of garland 87 are preferably secured around each of the individual ringed components of this artificial tree. Ornaments 88 may then be secured to the garland as shown. This permits the tree of this invention to have several benefits over existing artificial trees. For example, after the tree has been assembled and decorated initially, at the end of the holiday season the top section 12 and bottom section 14 may be compressed upon each other as the string 55 is no longer required to be held taut. With the top and bottom sections 12 and 14 respectively being in a compressed mode, the garland and ornaments are still on the tree, with the maximum overall diameter preferably being approximately 42". Thus, the following year, all that needs to be done is to secure the top and bottom sections 12 and 14 to the pole 16 in order to result in a fully decorated tree. This is believed particularly helpful for individuals not having the manual dexterity to place ornaments over an entire tree year after year, organizations requiring the relatively swift assembly and placement of decorated artificial trees, and for others desiring the added convenience associated with the tree of this invention.

Figure 9:
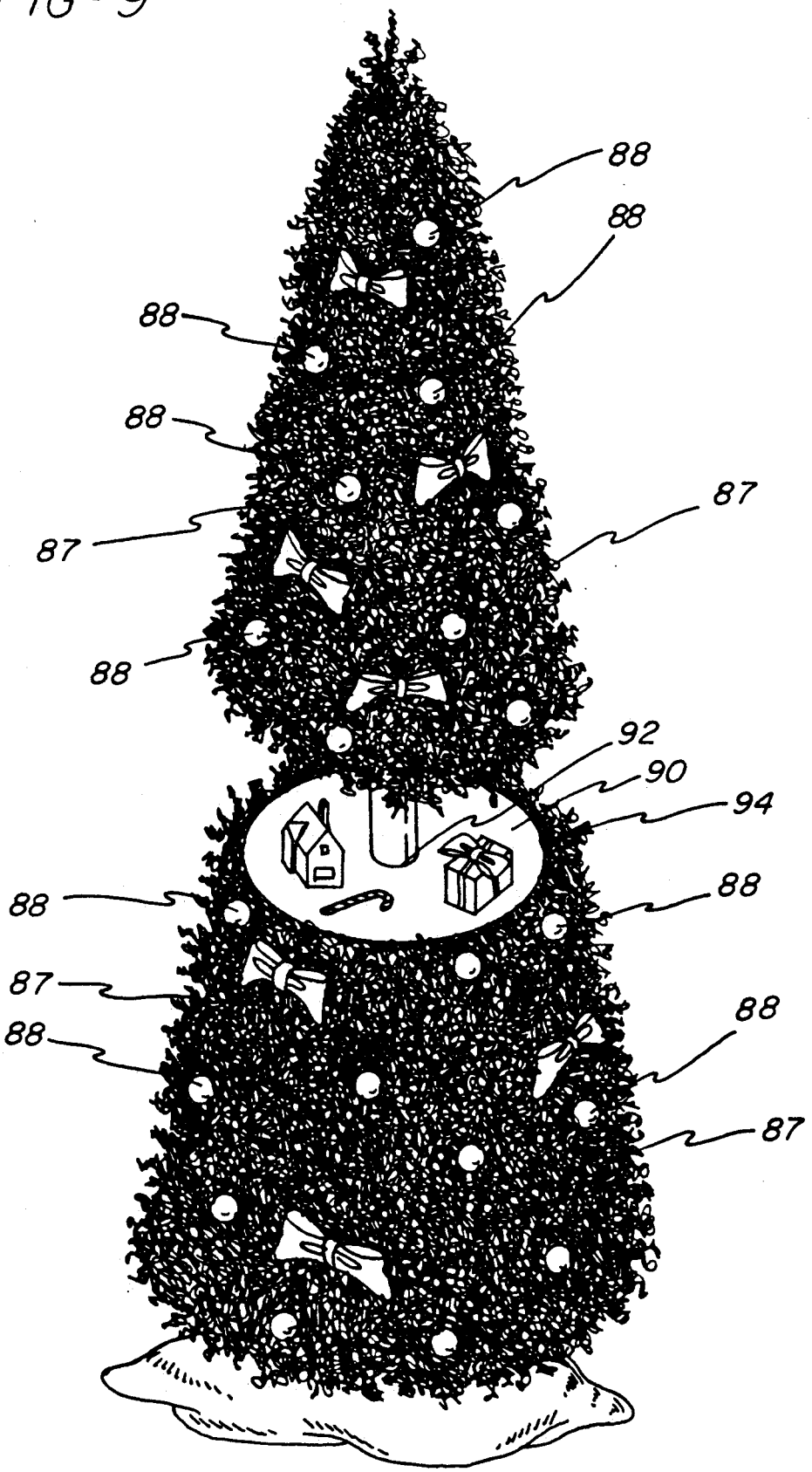
FIG. 9 is of a modified embodiment of the invention similar to FIG. 8 but having an open area such that the invention additionally functions as a holiday display device.

A modified embodiment of the invention is shown in FIG. 9. In this particular embodiment, a disc 90 preferably having a planar configuration and having a disc aperture 92 and disc bottom surface 94 is superposed adjacent the adjustment means top surface 26. A space is then provided between the disc 90 and the top section base ring 64 such that in the open space between the top section and bottom section 12 and 14 respectively a display of some kind can be placed on the disc 90. This holiday display for example could feature a number of wrapped gifts or other reminders of the holiday season. In order to provide this open space between the top section 12 and bottom section 14, the upper section of the pole may be raised slightly more than normal through the telescoping pole 16 before it is secured by the height adjustment means 24.

The assembly of the collapsible tree of this invention is accomplished as follows. The pole 16 is secured to stand 18 such that it projects upwardly from the floor area. The bottom section 14 is placed over the top of the pole such that the bottom section base ring depends downwardly from the bottom section top ring which sets atop the adjustment means 24. Preferably the upper pole section 20 is raised and clamped at the desired height. The top section is then placed over the upper pole section with the top member 30 frictionally secured to the upper pole section top 70 and with the other ringed components of the top section having downwardly by means of strings 55. Alternatively the top member can be placed over the upper pole section 20 before the upper pole section is raised. This is particularly helpful for individuals who find it difficult to reach heights associated with the top member 30 in its final operative position.

Additionally, the ringed sections can be rotated around the tree, thereby permitting an individual to decorate the entire tree while remaining in one position. This is extremely helpful for individuals who have limited mobility.

While the form of apparatus herein constitutes a preferred embodiment of this invention, it is to be understood that the invention is not limited to this precise form of apparatus, and that changes may be made therein without departing from the scope of the invention which is defined in the appended claims.

What is claimed is:

1. An artificial tree comprising a top section, said top section comprising a top member, a top section base ring, a plurality of rings interposed between said top member and said top section bottom base ring, and a plurality of strings depending downwardly from said top member to said top section base ring, said strings being secured to said rings interposed between said top member and to said top section base ring, a bottom section, said bottom section comprising a bottom section top ring and a bottom section base ring, a plurality of rings interposed between said bottom section top ring and said bottom section base ring, and a plurality of strings depending downwardly from said bottom section top ring to said bottom section base ring, each of said top section base ring, bottom section top ring and bottom section base ring comprising an inner hub with a plurality of spokes connecting each of said inner hubs with their respective top ring and base rings, a centrally positioned, vertical pole, said pole having means for height adjustment, said height adjustment means being of a greater diameter than the outer diameter of said pole, said height adjustment means having a top surface, said pole having a top surface positioned adjacent said top member, said bottom section top ring positioned adjacent said height adjustment means.

2. The tree according to claim 1 wherein said pole comprises an upper pole section and a lower pole section telescopically oriented with respect to each other.

3. The tree according to claim 2 wherein said top member comprises a conic portion and a cylindrical portion, said cylindrical portion having formed therein a plurality of apertures, said cylindrical portion having a hollow tubular insert positioned therein.

4. The tree according to claim 3 wherein each of said strings of said top section and of said bottom section is secured to said rings at attachment points, said attachment points being equally spaced from adjacent attachment points.

5. The tree according to claim 4 which includes strands of garland, with each strand of garland secured to a respective ring, top section base ring, bottom section top ring, or bottom section base ring.

6. The tree according to claim 5 which includes ornaments secured to said garland strands.

7. The tree according to claim 6 which includes a planar structure superposed above said bottom section top ring.

8. The tree according to claim 1 which includes strands of garland, with each strand of garland secured to a respective ring, top section base ring, bottom section top ring, or bottom section base ring.

9. The tree according to claim 8 which includes ornaments secured to said garland strands.

10. The tree according to claim 9 which includes a planar structure superposed above said bottom section top ring.

11. The tree according to claim 10 wherein said planar structure is spaced far enough below said top section base ring so as to accommodate a display on said planar structure.

12. The tree according to claim 1 wherein said top section is collapsible upon itself and said bottom section is collapsible upon itself.

13. An artificial tree comprising a top section, said top section comprising a top member, a top section base ring, a plurality of rings interposed between said top member and said top section bottom base ring, and a plurality of strings depending downwardly from said top member to said top section base ring, said strings being secured to said rings interposed between said top member and to said top section base ring, said top member comprising a conic portion and a cylindrical portion, said cylindrical portion having formed therein a plurality of apertures, said cylindrical portion having a hollow tubular insert positioned therein, a bottom section, said bottom section comprising a bottom section top ring and a bottom section base ring, a plurality of rings interposed between said bottom section top ring and said bottom section base ring, and a plurality of strings depending downwardly from said bottom section top ring to said bottom section base ring, each of said top section base ring, bottom section top ring and bottom section base ring comprising an inner hub with a plurality of spokes connecting each of said inner hubs with their respective top ring and base rings, said strings of said top section and of said bottom section secured to said rings at attachment points, said attachment points being equally spaced from adjacent attachment points, a centrally positioned, vertical pole, said pole comprising an upper pole section and a lower pole section telescopically oriented with respect to each other, said pole having means for height adjustment, said height adjustment means being of a greater diameter than the outer diameter of said pole, said height adjustment means having a top surface, said pole having a top surface positioned adjacent said top member, said bottom section top ring positioned adjacent said height adjustment means, and strands of garland, with each strand of garland secured to a respective ring, top section base ring, bottom section top ring, or bottom section base ring.

14. The tree according to claim 13 which includes ornaments secured to said garland strands.

15. The tree according to claim 13 which includes a planar structure superposed above said bottom section top ring.

16. The tree according to claim 15 wherein said planar structure is spaced far enough below said top section base ring so as to accommodate a display on said planar structure.

17. The tree according to claim 13 wherein said top section is collapsible upon itself and said bottom section is collapsible upon itself.

* * * * *